US012006933B2

(12) United States Patent
Zhang et al.

(10) Patent No.: US 12,006,933 B2
(45) Date of Patent: Jun. 11, 2024

(54) SCROLL COMPRESSOR

(71) Applicant: Copeland Climate Technologies (Suzhou) Co. Ltd., Jiangsu (CN)

(72) Inventors: Yue Zhang, Jiangsu (CN); Ji Liang, Jiangsu (CN)

(73) Assignee: Copleand Climate Technologies (Suzhou) Co. Ltd., Jiangsu (CN)

( * ) Notice: Subject to any disclaimer, the term of this patent is extended or adjusted under 35 U.S.C. 154(b) by 0 days.

(21) Appl. No.: 17/772,921

(22) PCT Filed: Aug. 13, 2020

(86) PCT No.: PCT/CN2020/108799
§ 371 (c)(1),
(2) Date: Apr. 28, 2022

(87) PCT Pub. No.: WO2021/082628
PCT Pub. Date: May 6, 2021

(65) Prior Publication Data

US 2022/0372976 A1 Nov. 24, 2022

(30) Foreign Application Priority Data

Oct. 31, 2019 (CN) ..... 201911052069.8
Oct. 31, 2019 (CN) ..... 201921862428.1

(51) Int. Cl.
*F04C 18/02* (2006.01)
*F04C 27/00* (2006.01)
*F04C 29/00* (2006.01)

(52) U.S. Cl.
CPC ..... *F04C 18/0215* (2013.01); *F04C 27/005* (2013.01); *F04C 29/00* (2013.01); *F04C 29/0021* (2013.01); *F04C 2240/805* (2013.01)

(58) Field of Classification Search
CPC .. F04C 18/0207–0292; F04C 2240/805; F04C 27/005; F04C 29/00; F04C 29/0021; F04C 29/0028
See application file for complete search history.

(56) References Cited

U.S. PATENT DOCUMENTS 5,102,316 A 4/1992 Caillat et al.
5,407,335 A 4/1995 Caillat et al.
(Continued)

FOREIGN PATENT DOCUMENTS

CN 1670335 A 9/2005
CN 1932246 A 3/2007
(Continued)

OTHER PUBLICATIONS

International Search Report (English and Chinese) and Written Opinion of the International Searching Authority (Chinese) issued in PCT/CN2020/108799, dated Nov. 13, 2020; ISA/CN.

*Primary Examiner* — Mark A Laurenzi
*Assistant Examiner* — Xiaoting Hu
(74) *Attorney, Agent, or Firm* — Harness, Dickey & Pierce, P.L.C.

(57) ABSTRACT

A scroll compressor comprising: a fixed scroll and a moving scroll, the moving scroll being configured to be capable of orbiting relative to the fixed scroll in order to compress fluid; a main bearing base supporting the moving scroll; and an axial flexible mounting mechanism, the fixed scroll being connected to the main bearing base by means of the axial flexible mounting mechanism, such that the fixed scroll can move a predetermined distance along the axial direction, the axial flexible mounting mechanism comprising a bolt and a sleeve arranged on the outer circumference of the bolt, the sleeve comprising in the axial direction a first section in contact with the main bearing base and a second section in contact with the fixed scroll, and the first section being
(Continued)

configured such that the bending rigidity in the radial direction is different to the bending rigidity in the tangential direction.

13 Claims, 16 Drawing Sheets

(56) References Cited

U.S. PATENT DOCUMENTS

| | | | | |
|---|---|---|---|---|
| 5,527,166 | A * | 6/1996 | Chang | F04C 18/0215 418/57 |
| 2005/0201883 | A1* | 9/2005 | Clendenin | F01C 21/003 418/55.5 |
| 2007/0059192 | A1* | 3/2007 | Stover | F04C 18/0215 418/55.1 |
| 2013/0121857 | A1 | 5/2013 | Liang et al. | |
| 2013/0287617 | A1* | 10/2013 | Siefring | F04C 18/0207 418/55.1 |
| 2015/0152868 | A1* | 6/2015 | Fu | F04C 29/0021 418/55.5 |
| 2017/0350396 | A1* | 12/2017 | Su | F04C 29/06 |

FOREIGN PATENT DOCUMENTS

| | | | |
|---|---|---|---|
| CN | 201339575 | Y | 11/2009 |
| CN | 103114995 | A | 5/2013 |
| CN | 205689426 | U | 11/2016 |
| CN | 108131292 | A | 6/2018 |

* cited by examiner

SCROLL COMPRESSOR

This application is the national phase of International Application No. PCT/CN2020/108799 titled "SCROLL COMPRESSOR" and filed on Aug. 13, 2020, which claims priorities to the Chinese patent applications Nos. 201911052069.8 and 201921862428.1 titled "SCROLL COMPRESSOR" and filed with the China National Intellectual Property Administration on Oct. 31, 2019. These applications are incorporated herein by reference.

FIELD

The present disclosure relates to a scroll compressor, and in particular to a sleeve capable of preventing an axial flexible mounting mechanism from failing and a scroll compressor including the sleeve.

BACKGROUND

The contents of this section only provide background information related to the present disclosure, which may not constitute the conventional technology.

A scroll compressor may be applied in, for example, a refrigeration system, an air conditioning system, and a heat pump system. The scroll compressor includes a compression mechanism for compressing a working fluid (e.g., a refrigerant), a main bearing seat for supporting the compression mechanism, a rotating shaft for driving the compression mechanism, and a motor for driving the rotating shaft to rotate. The compression mechanism includes a non-orbiting scroll and an orbiting scroll that revolves around the non-orbiting scroll. The non-orbiting scroll and the orbiting scroll each include an end plate and a scroll blade extending from one side of the end plate. When the orbiting scroll orbits around the non-orbiting scroll, a series of moving compression chambers with volume gradually decreasing from a radial outer side to a radial inner side are formed between the scroll blade of the non-orbiting scroll and the scroll blade of the orbiting scroll, so that the working fluid is compressed.

During the normal operation of the scroll compressor, a good seal needs to be achieved between a tip end of the scroll blade of one of the non-orbiting scroll and the orbiting scroll and an end plate of the other of the non-orbiting scroll and the orbiting scroll. On the other hand, for example, in a case that the compression chamber of the scroll compressor has excessive pressure, the scroll blade can be separated from the end plate to unload the high-pressure fluid, thereby avoiding damage to the compression mechanism.

In view of this, the non-orbiting scroll is mounted to the main bearing seat via axial flexible mounting mechanisms, so that the non-orbiting scroll can axially move a certain distance relative to the orbiting scroll. Each axial flexible mounting mechanism generally includes a bolt and a sleeve located outside the bolt. Bolts are inserted into mounting holes of the non-orbiting scroll to screw the non-orbiting scroll to the main bearing seat. Sleeves are also inserted into the mounting holes of the non-orbiting scroll and are provided between heads of the bolts and the main bearing seat, so that a certain gap for axial movement of the non-orbiting scroll is defined between the heads of the bolts and the non-orbiting scroll.

However, during the operation of the scroll compressor, the bolts are often loosened or even broken.

SUMMARY

The inventor of the present application found that the bolts of the axial flexible mounting mechanisms are liable to get loose or fracture. Therefore, reasons for the fatigue damage of the bolts have been deeply studied, and a solution that can improve the fatigue strength of the bolts has been proposed.

An object of the present disclosure is to provide a scroll compressor that can prevent or reduce damage to the axial flexible mounting mechanisms.

According to an aspect of the present disclosure, a scroll compressor is provided. The scroll compressor includes: a non-orbiting scroll and an orbiting scroll, where the orbiting scroll is configured to orbit relative to the non-orbiting scroll to compress a fluid; a main bearing seat for supporting the orbiting scroll; an axial flexible mounting mechanism, via which the non-orbiting scroll is connected to the main bearing seat, so that the non-orbiting scroll is capable of moving a predetermined distance in an axial direction. The axial flexible mounting mechanism comprises a bolt and a sleeve arranged on the outer periphery of the bolt, wherein the sleeve includes a first section in contact with the main bearing seat and a second section in contact with the non-orbiting scroll in the axial direction, and wherein the first section is configured such that the bending stiffness in a radial direction is different from the bending stiffness in a tangential direction.

For a scroll compressor where the sleeve is subjected to a larger load in the radial direction, the sleeve is configured to have a larger bending stiffness in the radial direction; and for a scroll compressor where the sleeve is subjected to a larger load in the tangential direction, the sleeve is configured to have a larger bending stiffness in the tangential direction.

The sleeve includes a cylindrical portion and a wing portion extending outward from the outer periphery of the cylindrical portion, the first section is formed by a section of the sleeve provided with wing portion, and the second section is formed by a section of the sleeve including only the cylindrical portion.

The dimension of the wing portion in the tangential direction is different from the dimension of the wing portion in the radial direction. For a scroll compressor where the sleeve is subjected to a larger load in the radial direction, the radial dimension of the wing portion is larger. And for the scroll compressor where the sleeve is subjected to a larger load in the tangential direction, the tangential dimension of the wing portion is larger.

Optionally, the cylindrical portion and the wing portion are formed integrally or separately.

Optionally, when the cylindrical portion and the wing portion are formed separately: the lower end surface of the cylindrical portion is flush with the lower end surface of the wing portion, and the two end surfaces together constitute the end surface of the sleeve that is in contact with the main bearing seat; or the lower end surface of the cylindrical portion is not flush with the lower end surface of the wing portion, and the lower end surface of the wing portion constitutes the end surface of the sleeve that is in contact with the main bearing seat.

Optionally, when the cylindrical portion and the wing portion are formed separately, the cylindrical portion and the wing portion are connected in an interference manner.

Optionally, the main bearing seat includes a boss connected with axial flexible mounting mechanism, the wing portion does not extend beyond the outer contour of the boss in the direction in which the sleeve is subjected to a larger load.

Optionally, the boss is further provided with an alignment wall extending in the axial direction towards the non-orbiting scroll.

Optionally, the wing portion further comprises a cutout portion extending toward the non-orbiting scroll in the axial direction from the lower end surface of the wing portion that is in contact with the main bearing seat, for accommodating the alignment wall.

Optionally, the alignment wall is in contact with the cutout portion and/or the cylindrical portion for limiting the position of the sleeve.

Optionally, the lower end of the wing portion is configured to have a pair of crescent-shaped stepped portions. The stepped portions surround the through hole in the center of the wing portion and are arranged on both sides of the through hole along the direction in which the sleeve is subjected to a larger load. The lower end surface of the stepped portion is configured as the lower end surface of the wing portion that is in contact with the main bearing seat.

Optionally, the lower end of the wing portion is configured to have one stepped portion. The stepped portion is arranged to surround the through hole in the center of the wing portion. The stepped portion has the same or smaller size than the cylindrical portion in the direction in which the sleeve is subjected to a smaller load. The lower end surface of the stepped portion is configured as the lower end surface of the wing portion that is in contact with the main bearing seat.

Optionally, the first section is located between the non-orbiting scroll and the main bearing seat, and at least a part of the second section is inserted into a mounting hole of the non-orbiting scroll.

From the following detailed description, other application fields of the present disclosure will become more apparent. It should be understood that, although these detailed descriptions and specific examples show preferred embodiments of the present disclosure, these detailed descriptions and specific examples are intended to achieve the purpose of illustrative description, rather than to limit the present disclosure.

BRIEF DESCRIPTION OF THE DRAWINGS

The features and advantages of one or more embodiments of the present disclosure will become more readily understood from the following description with reference to the accompanying drawings in which.

DETAILED DESCRIPTION OF THE EMBODIMENTS

Exemplary embodiments will now be described more comprehensively with reference to the accompanying drawings.

Exemplary embodiments are provided so that the present disclosure will be thorough and will more fully convey the scope to those skilled in the art. Many specific details such as examples of specific components, devices, and methods are described to provide a thorough understanding of various embodiments of the present disclosure. It will be clear to those skilled in the art that the exemplary embodiments may be implemented in many different forms without using specific details, none of which should be construed as limiting the scope of the present disclosure. In some exemplary embodiments, well-known processes, well-known device structures, and well-known technologies are not described in detail.

Figure 1:
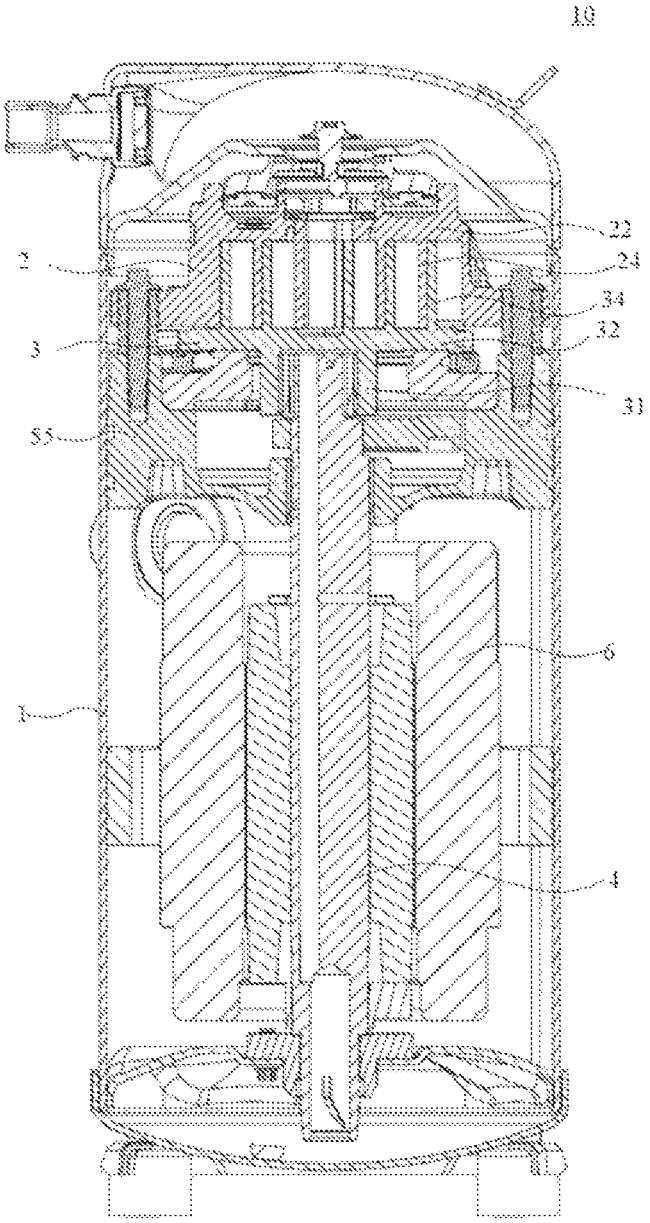
FIG. 1 is a radial longitudinal sectional view of a conventional scroll compressor.

The general structure of a scroll compressor 10 will be described below with reference to FIG. 1. As shown in the figure, the compressor 10 includes a housing 1, a compression mechanism, a motor 6, a rotating shaft (also referred to as a drive shaft or a crankshaft) 4, and a main bearing seat 5.

The compression mechanism includes a non-orbiting scroll 2 and an orbiting scroll 3. The motor 6 is configured to drive the rotating shaft 4 to rotate, and then the rotating shaft 4 is configured to drive the orbiting scroll 3 to orbit around the non-orbiting scroll 2 (i.e., a center axis of the orbiting scroll revolves around a central axis of the non-orbiting scroll, but the orbiting scroll does not rotate around its own center axis) to compress the working fluid.

Figure 2:
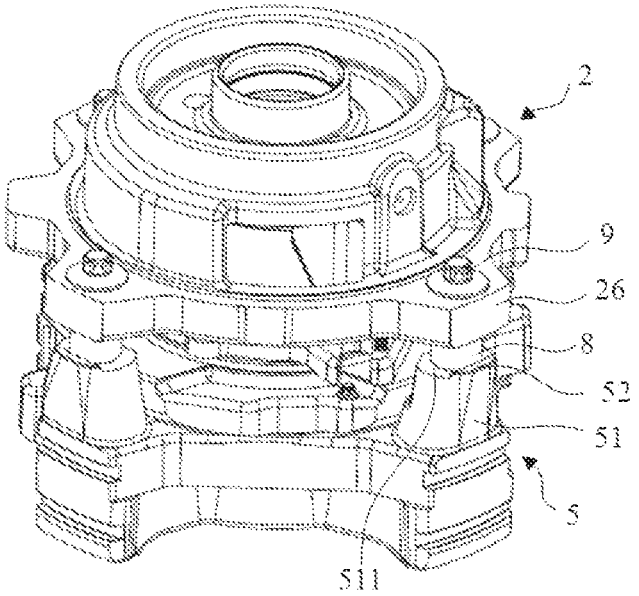
FIG. 2 is a partial perspective view of the scroll compressor of FIG. 1, in which the non-orbiting scroll, the main bearing seat and the axial flexible mounting mechanisms are shown.

The non-orbiting scroll 2 may be fixed relative to the housing 1 in any suitable manner. As shown in the figure, the non-orbiting scroll 12 is fixedly mounted to the main bearing seat 5 by bolts, which will be described in detail later. The non-orbiting scroll 2 may include a non-orbiting scroll end plate 22 and a non-orbiting scroll blade 24 extending from one side of the non-orbiting scroll end plate 22. As shown in FIG. 2, the non-orbiting scroll 2 further has flanges 26 extending radially outward from its radially outermost outer peripheral surface. A mounting hole for receiving an axial flexible mounting mechanism is defined in each of the flanges 26, so as to connect the non-orbiting scroll 12 to the main bearing seat 5.

The orbiting scroll 3 may include an orbiting scroll end plate 32, an orbiting scroll blade 34 formed on one side of the orbiting scroll end plate 32, and a hub 31 formed on the other side of the orbiting scroll end plate 32. The non-orbiting scroll blade 24 and the orbiting scroll blade 34 can be engaged with each other, so that a series of moving compression chambers with volume gradually decreasing from a radial outer side to a radial inner side are formed between the non-orbiting scroll blade 24 and the orbiting scroll blade 34 during operation of the scroll compressor, so as to compress the working fluid. The hub 31 is coupled to the rotating shaft 4 via an eccentric crank pin and is driven by the eccentric crank pin.

The main bearing seat 5 is suited for supporting the orbiting scroll end plate 32 of the orbiting scroll 3. The orbiting scroll end plate 32 orbits on a supporting surface of the main bearing seat 5. The main bearing seat 5 could be fixed with respect to the housing 1 of the scroll compressor 10 by any suitable means.

In order to achieve fluid compression, an effective seal is required between the non-orbiting scroll 2 and the orbiting scroll component 3.

On the one hand, during the normal operation of the scroll compressor, a radial seal is further required between a side surface of the scroll blade 24 of the non-orbiting scroll 2 and a side surface of the scroll blade 34 of the orbiting scroll 3. The radial seal between the two is generally achieved by a centrifugal force of the orbiting scroll 3 during operation and a driving force provided by the rotating shaft 4. In a case that incompressible foreign matter (e.g., solid impurities and liquid refrigerant) enters the compression chamber and gets stuck between the scroll blades 24 and 34, the scroll blades 24 and 34 can be temporarily separated from each other in the radial direction to allow the foreign matter to pass through, thereby preventing the scroll blades 24 and 34 from being damaged, so as to provide the scroll compressor 10 with radial flexibility.

On the other hand, during the normal operation of the scroll compressor, an axial seal is required between a tip of the scroll blade 24 of the non-orbiting scroll 2 and the end plate 32 of the orbiting scroll 3, and an axial seal is required between a tip of the scroll blade 34 of the orbiting scroll 3 and the end plate 22 of the non-orbiting scroll 2. In a case that the compression chamber of the scroll compressor has excessive pressure, the fluid in the compression chamber leaks to the low-pressure side through a gap between the tip of the scroll blade 24 of the non-orbiting scroll 2 and the end plate 32 of the orbiting scroll 3 and a gap between the tip of the scroll blade 34 of the orbiting scroll 3 and the end plate 22 of the non-orbiting scroll 2 to achieve unloading, thereby providing the scroll compressor 10 with axial flexibility.

In order to provide axial flexibility, the non-orbiting scroll 2 is mounted to the main bearing seat 5 via the axial flexible mounting mechanisms. Referring to FIG. 2, the main bearing seat 5 is provided at its radially outermost side with bosses 51 extending in the axial direction, and each of the bosses 51 is axially aligned with the corresponding flange 26 of the non-orbiting scroll 2. It should be noted that, since it is necessary to leave enough installation space for other components in the radial direction, the boss 51 is generally designed in a substantially frustum shape with a length in the radial direction smaller than a length in the circumferential (tangential) direction. In addition, the radially outermost side of the boss 51 is further provided with an alignment wall 52 extending axially towards the flange 26 to facilitate the alignment and assembly of the non-orbiting scroll 2, the axial flexible mounting mechanism and the main bearing seat 5.

Figure 3A:
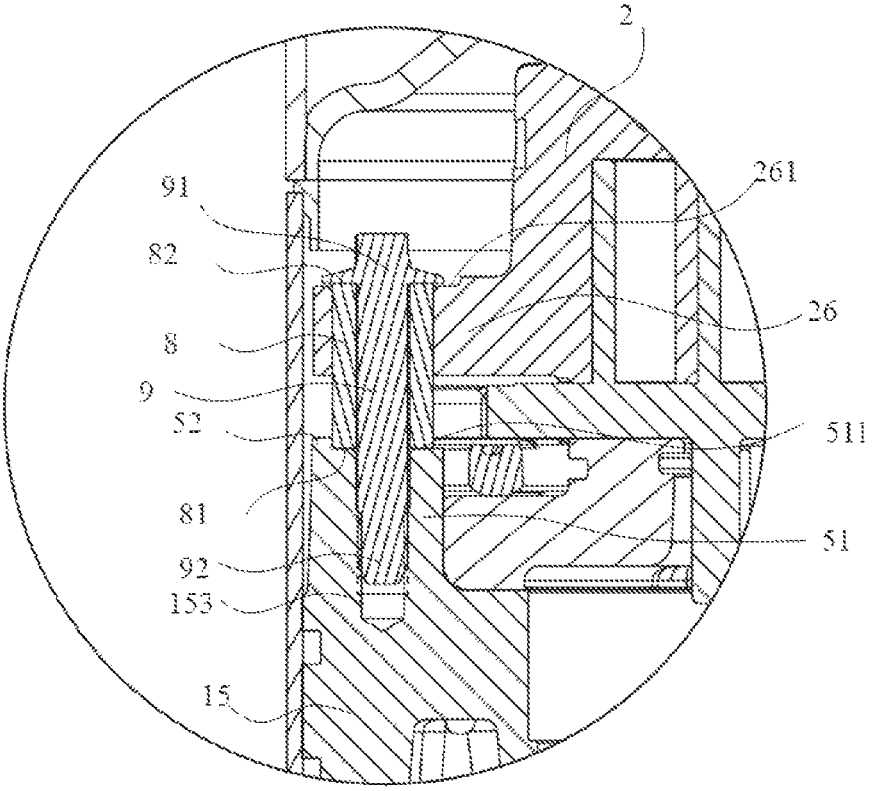
FIG. 3*a* and FIG. 3*b* are respectively a partial radial longitudinal sectional view and a partial tangential longitudinal sectional view of the scroll compressor of FIG. 1.
Figure 3B:
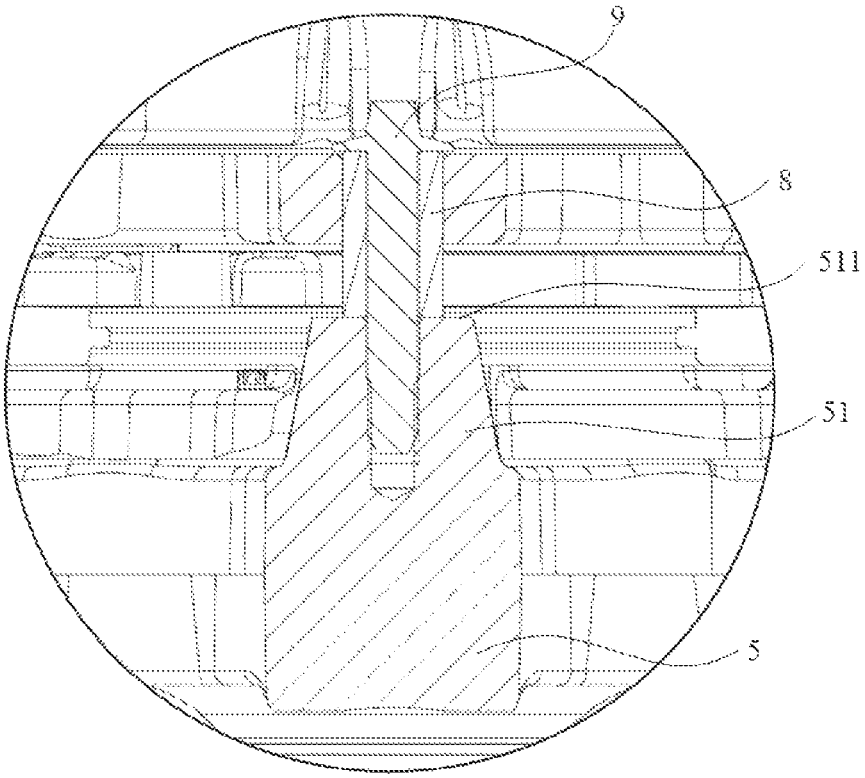

Referring to FIG. 3*a* and FIG. 3*b*, each of the axial flexible mounting mechanisms includes a bolt 9 and a sleeve 8 located radially outside the bolt 9. The bolt 9 has a rod portion, a head 91 located at one end of the rod portion, and a threaded portion 92 located at the other end of the rod portion. The head 91 is in contact with the upper end surface (second end surface) 82 of the sleeve 8 and the upper surface 261 of the flange 26. The threaded portion 92 is configured to be able to be screwed into a threaded hole of the boss of the main bearing seat 5. The sleeve 8 is also received in the mounting hole of the flange 26 of the non-orbiting scroll 2, and the lower end surface (first end surface) 81 of the sleeve 8 is in contact with the upper surface (contact surface) 511 of the boss 51. That is, the sleeve 8 is located between the head 91 and the upper surface 511 of the boss 51 of the main bearing seat 5, thereby defining the position of the head 91 so that the non-orbiting scroll 2 is capable of moving a predetermined distance in the axial direction.

Since the sleeve 8 is received in the mounting hole of the flange 26 of the non-orbiting scroll to guide the movement of the non-orbiting scroll 2 in the axial direction, the sleeve 8 generally has a cylindrical outer contour, so as to fit into the mounting hole of the flange 26. The radially outermost outer wall of the sleeve 8 is in contact with the alignment wall 52 of the boss 51, thereby limiting the position of the sleeve 8 in the radial direction. In the existing scroll compressor, the tangential position of the sleeve is usually unlimited.

The inventor found that the bolts of the existing axial flexible mounting mechanisms are liable to get loose or fracture. When the orbiting scroll 3 orbits relative to the non-orbiting scroll 2, the blade side contact is generated due to the centripetal acceleration, and a force F acting on the sleeve 8 is generated. The force F applies a load on the bolt 9 via the sleeve 8, thereby causing the fracture failure of the bolt 9. If the force F is too large or the sleeve is not fully aligned with the bolt during installation, it may also cause the sleeve to get contact with the shank of the bolt, so that the load applied to the bolt increases sharply, and thus the bolt is more likely to loosen and break.

Figure 16A:
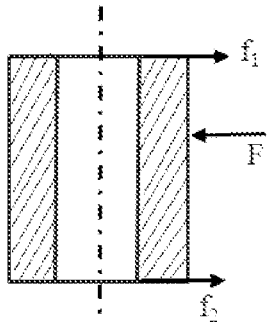
FIG. 16*a* and FIG. 16*b* are schematic diagrams respectively showing the force of the sleeve and the bolt during the operation of the compressor.
Figure 16B:
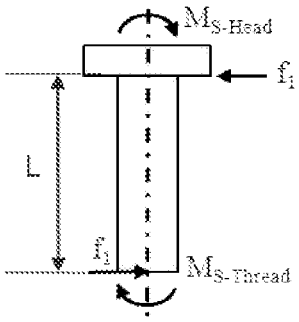

FIG. 16*a* and FIG. 16*b* respectively show in simplified form the force on the sleeve and the bolt under the condition that the sleeve and the shank of the bolt are not in contact. For the sleeve, the force F is in balance with the respective forces $f_1$ and $f_2$ on the upper end surface (the second end surface) and the lower end surface (the first end surface) of the sleeve, that is, the formula $F=f_1+f_2$ is satisfied. Meanwhile, the head of the bolt in contact with the second end surface of the sleeve is subjected to a force with the same magnitude and opposite direction as the force $f_1$, under the action of this force, the bolt is prone to fracture failure at its threaded portion, that is, at the position of the end portion of the bolt. The bending moment at the end portion of the bolt can be calculated by the following formula:

$$M_{S\text{-}Thread}=f_1L-M_{S\text{-}Head}.$$

It should be noted that, in existing scroll compressors, the force F tends to be large in one of the tangential and radial directions and be small in the other one of the tangential and radial directions. For ease of description, the present disclosure is described by taking the example that the sleeve is subjected to a large load in the tangential direction.

The present disclosure aims to reduce the load on the bolt and slow down or prevent the bolt from loosening or breaking by matching the stiffness direction of the sleeve with the load direction of the sleeve. That is, in the direction in which the sleeve is subjected to a larger load, the bending stiffness of the sleeve is also larger; in the direction in which the sleeve is subjected to a smaller load, the bending stiffness of the sleeve is also smaller.

Figure 4:
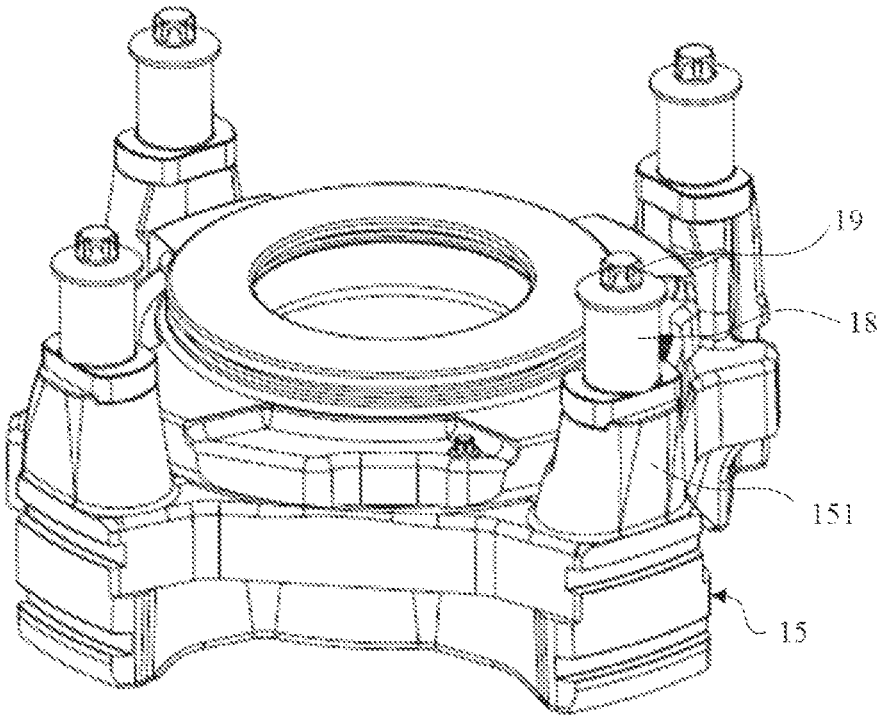
FIG. 4 is a partial perspective schematic view of the scroll compressor according to the first embodiment of the present disclosure, wherein the main bearing seat and the flexible mounting mechanism are shown.
Figure 5A:
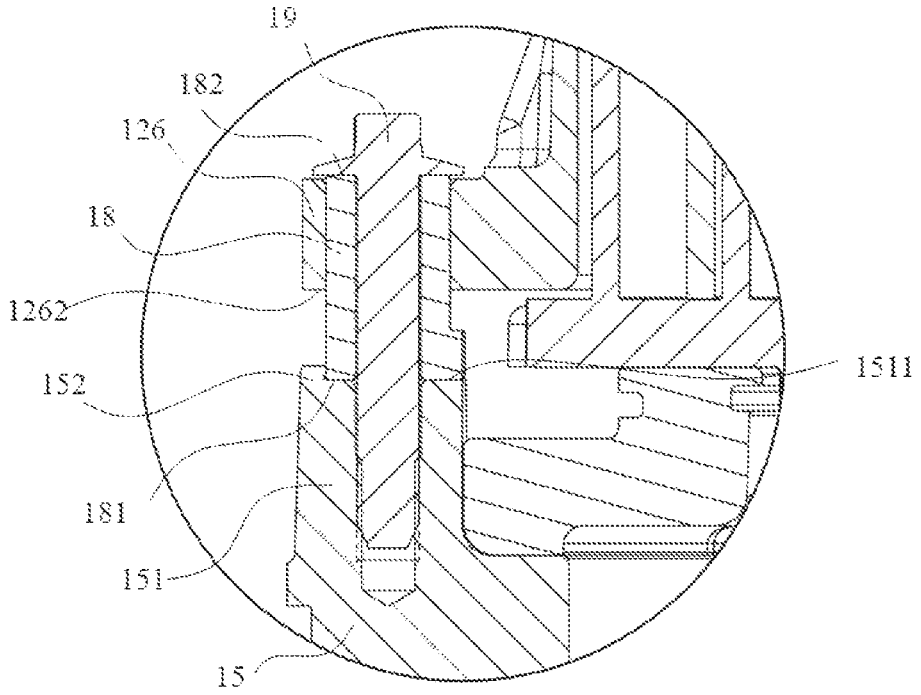
FIG. 5*a* and FIG. 5*b* are respectively a partial radial longitudinal sectional view and a partial tangential longitudinal sectional view of the scroll compressor according to the first embodiment of the present disclosure.
Figure 5B:
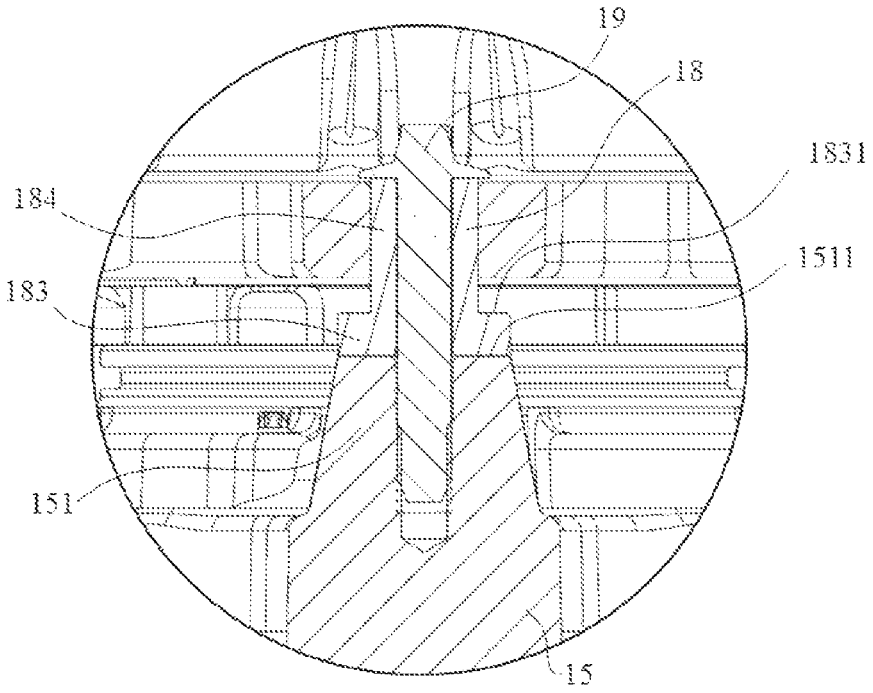

FIG. 4 shows a partial schematic view of the scroll compressor according to the first embodiment of the present disclosure, the axial flexible mounting mechanisms have been mounted on the bosses 151 of the main bearing seat 15, and the non-orbiting scroll has been removed to allow a clearer view of the axial flexible mounting mechanism. Each of the axial flexible mounting mechanism includes a bolt 19 and a sleeve 18 located radially outside the bolt 19. In the first embodiment, the structures of the non-orbiting scroll, the main bearing seat 15, and the bolts 19 and their installation positions and manners are similar to those of the existing scroll compressor described above, so they are not repeated here. Referring to FIG. 5*a* and FIG. 5*b*, the sleeve 18 is received in the mounting hole of the flange 126 of the non-orbiting scroll, and is located between the head of the bolt 19 and the upper surface (contact surface) 1511 of the boss 151 of the main bearing seat 15. The upper end surface (second end surface) 182 of the sleeve 18 is in contact with the lower surface of the head of the bolt 19, and the lower end surface (first end surface) 181 of the sleeve 18 is in contact with the upper surface (contact surface) 1511 of the boss 151.

Figure 6A:
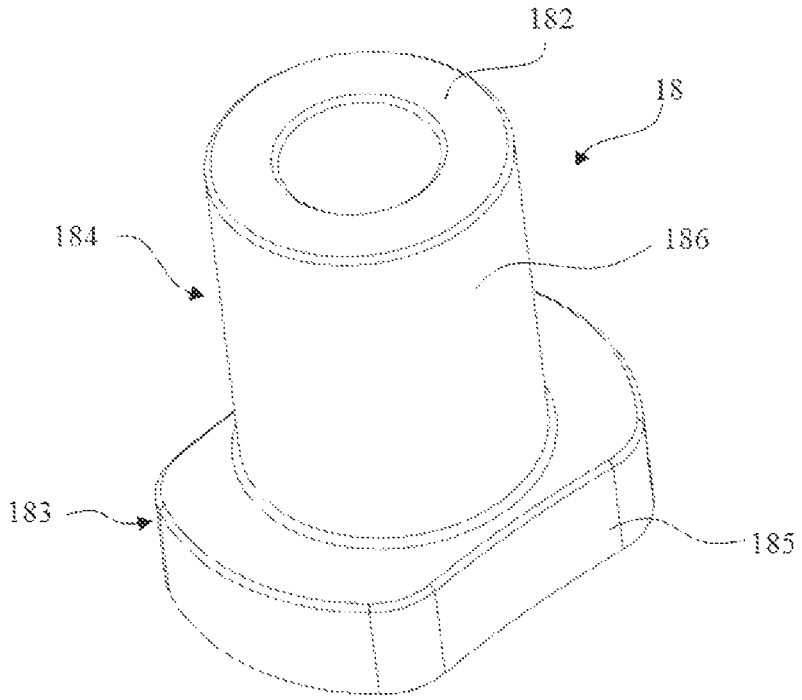
FIG. 6*a* and FIG. 6*b* are a schematic perspective view and a top view of the sleeve of the scroll compressor according to the first embodiment of the present disclosure, respectively.
Figure 6B:
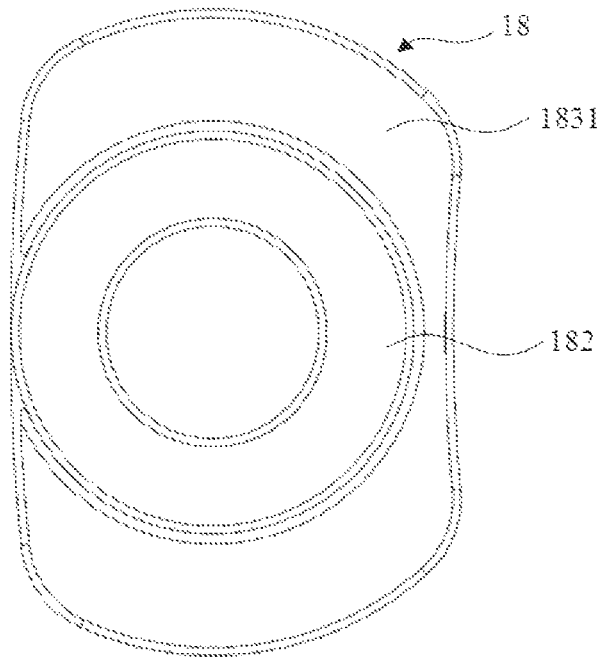

As shown in FIG. 6*a* and FIG. 6*b*, unlike the generally cylindrical sleeves 8 of existing axial flexible mounting mechanisms, the sleeve 18 includes a first section 183 having a first end surface 181 and a second section 184 having a second end surface 182. The second section 184 has a substantially cylindrical shape, and its dimension in the radial direction is substantially the same as its dimension in the tangential direction. The first section 183 is configured to have wings extending outward from the outer peripheral wall of the second section 184, especially in the tangential direction, so that the dimension in the tangential direction of the outer contour of the first section 183 is larger than the dimension in the radial direction. In the tangential direction, the outer contour of the first section 183 does not extend beyond the contour of the upper surface (contact surface) 1511 of the boss 151, the outer contour of the first section 183 is preferably substantially the same as the contour of the upper surface (contact surface) 1511 of the boss 151, thereby increasing the size of the first section as much as possible in a limited space and facilitating processing and installation. In the radial direction, the radially outermost outer wall of the first section 183 is substantially flush with the outer peripheral wall of the second section 184 and is in contact with the alignment wall 152 of the boss 151. The radially innermost outer wall of the first section 183 may be approximately flush with or may slightly exceed the radially inner side wall of the boss 151, as long as it does not interfere with other components in the compressor.

Since the dimension of the first section in the tangential direction is larger than the dimension in the radial direction, the bending stiffness of the sleeve in the tangential direction is increased. According to the force situation of the sleeve and bolt shown in FIG. 16*a* and FIG. 16*b*, under the condition that the force F is constant, increasing the bending stiffness of the sleeve in the tangential direction can change the bending moment distribution on the sleeve, resulting in a reduction of the force F1 on the upper surface of the sleeve. Therefore, the f1 acting on the bolt is also reduced, thus reducing the bending moment and stress at the end of the bolt, enhancing the fatigue strength of the bolt and greatly reducing the risk of bolt fracture failure. In addition, in the case that the first section is in contact with the alignment wall, since the first section is provided as a non-cylindrical structure whose dimension in the tangential direction is larger than the dimension in the radial direction, the sleeve can be effectively prevented from rotating. Furthermore, since the area of the first end surface of the sleeve is increased compared with the conventional cylindrical sleeve, the impression of the sleeve on the boss can be reduced.

As shown in FIG. 5*a* and FIG. 5*b*, in the scroll compressor, preferably, the upper surface 1831 of the first section 183 does not exceed the lower surface 1262 of the flange 126 in the axial direction. That is, the first section 183 is located between the flange 126 of the non-orbiting scroll end plate and the boss 151 of the main bearing seat 15 and is not inserted into the mounting hole of the flange 126, and only the second section 184 is inserted into the mounting hole of the flange 126. Since the second section 184 can have a size that is compatible with the mounting hole of the existing flange 126, therefore, the problem of broken or loose bolts can be improved by only being replaced with the sleeve according to the present disclosure without modifying or replacing other components such as the orbiting scroll. Of course, the upper surface 1831 of the first section 183 may also exceed the lower surface 1262 of the flange 126 in the axial direction, as long as the mounting hole of the flange 126 is manufactured in a shape suitable for the outer contour of the first section 183.

The scroll compressor according to the second embodiment of the present disclosure is described below with reference to FIG. 7 to FIG. 9*d*. Similar to the scroll compressor according to the first embodiment of the present disclosure shown in FIG. 4 to FIG. 6*b*, the scroll compressor according to the second embodiment of the present disclosure includes a non-orbiting scroll, axial flexible mounting mechanisms, a main bearing seat 25, and the like. Each of the axial flexible mounting mechanisms includes a bolt 29 and a sleeve 28 located radially outside the bolt 29. In the second embodiment, the structures, positions, manners and the like of the non-orbiting scroll, the main bearing seat 25 and the bolt 29 are similar to those of the scroll compressor of the first embodiment described above, so they are not described again.

Figure 7:
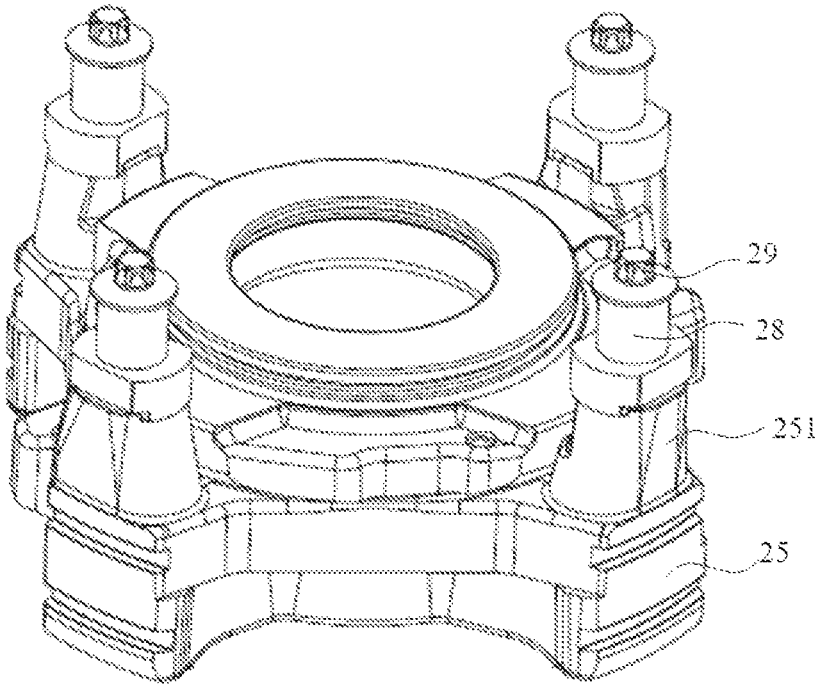
FIG. 7 is a partial perspective schematic view of the scroll compressor according to the second embodiment of the present disclosure, wherein the main bearing seat and the flexible mounting mechanism are shown.
Figure 8A:
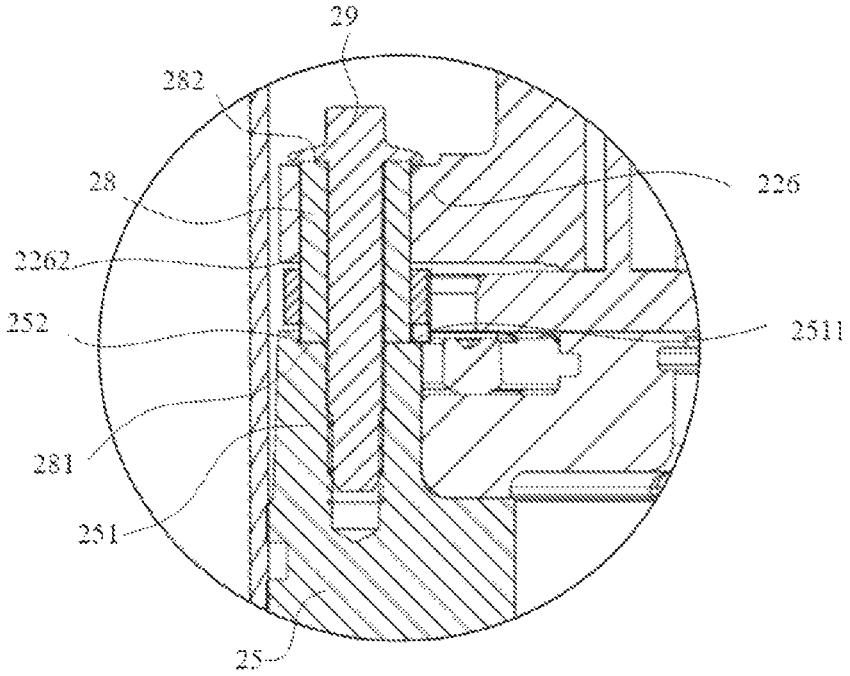
FIG. 8*a* and FIG. 8*b* are respectively a partial radial longitudinal sectional view and a partial tangential longitudinal sectional view of the scroll compressor according to the second embodiment of the present disclosure.
Figure 8B:
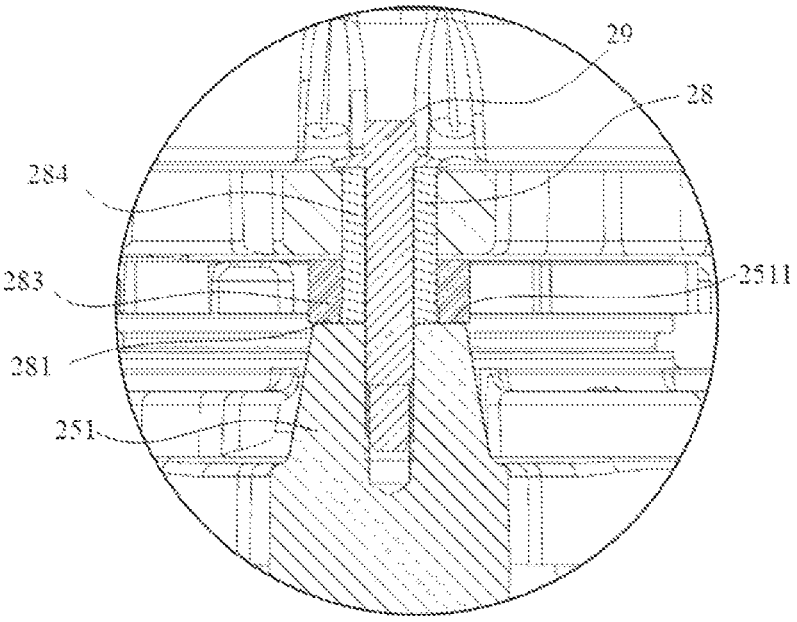

FIG. 7 shows a partial schematic view of the scroll compressor according to the second embodiment of the present disclosure, the axial flexible mounting mechanisms have been mounted on the main bearing seat 25, and the non-orbiting scroll has been removed to allow a clearer view of the axial flexible mounting mechanisms. Referring to FIG. 8*a* and FIG. 8*b*, the sleeve 28 is received in the mounting hole of the flange of the non-orbiting scroll, and is located between the head of the bolt 29 and the upper surface (contact surface) 2511 of the boss 251 of the main bearing seat 25. The second end surface 282 of the sleeve 28 is in contact with the lower surface of the head of the bolt 29, and the first end surface 281 of the sleeve 28 is in contact with the upper surface 2511 of the boss 251.

Figure 9A:
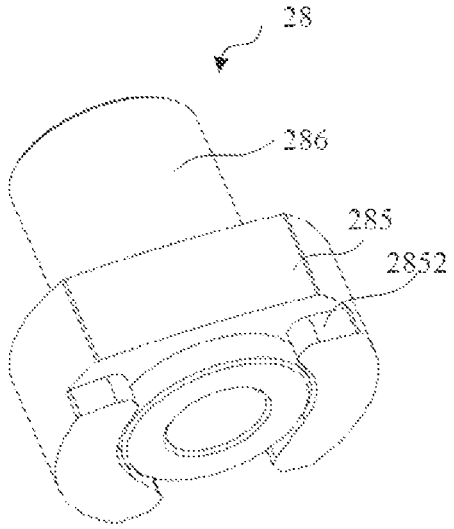
FIG. 9*a* is a schematic perspective view of a sleeve of a scroll compressor according to a second embodiment of the present disclosure.
Figure 9B:
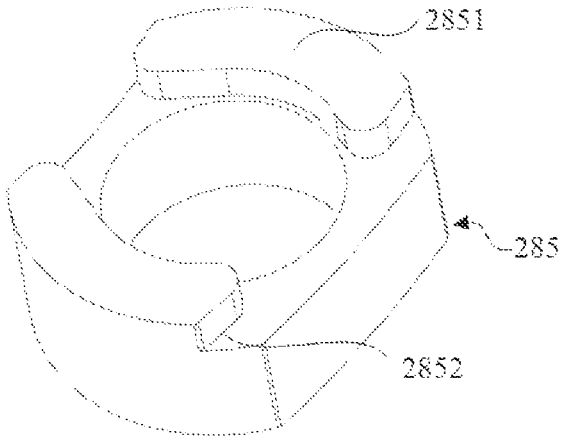
FIG. 9*b*, FIG. 9*c* and FIG. 9*d* are perspective views of the wing of the sleeve, perspective views of the cylinder of the sleeve and bottom views of the wing of the sleeve of FIG. 9*a*, respectively.
Figure 9C:
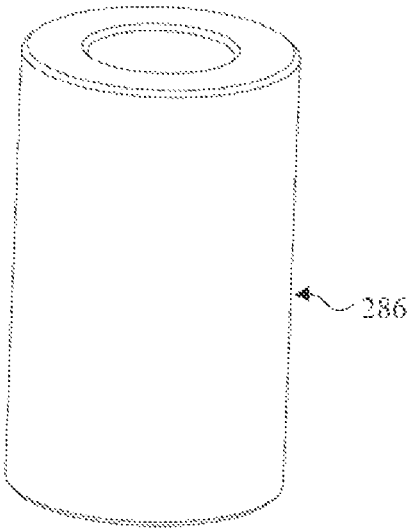
Figure 9D:
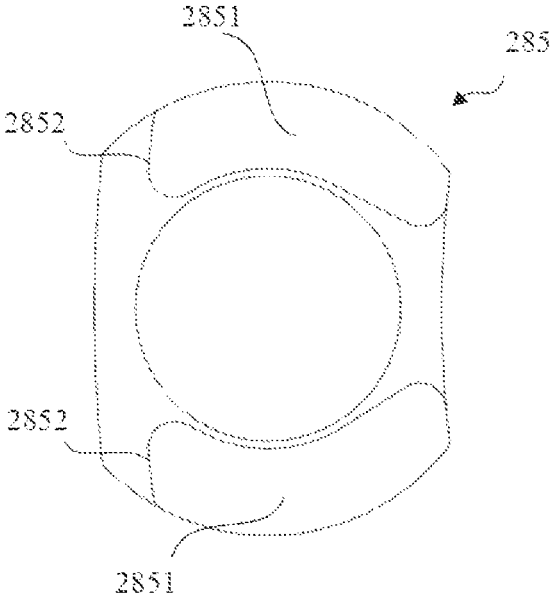

As shown in FIG. 9*a* to FIG. 9*d*, unlike the integrally formed sleeve 18 including wing portions in the first embodiment, the sleeve 28 is constructed in the form of an assembly including a cylindrical portion 286 and wing portions 285 formed separately. FIG. 9*a* shows the sleeve after the cylindrical portion and the wing portion are assembled, wherein the lower end of the cylindrical portion 286 is inserted into the through hole in the center of the wing portion 285. FIG. 9*c* and FIG. 9*b* show the unassembled cylindrical portion and wing portion, respectively, wherein the cylindrical portion 286 is similar in structure to a substantially cylindrical sleeve in a conventional scroll compressor, and includes an upper end surface and a lower end surface. The wing portions 285 are then configured in a shape similar to the shape of that in the first embodiment, wherein the dimensions of the outer contour thereof in the tangential direction are larger than those in the radial direction.

In order to facilitate production, processing and assembly, the lower end of the wing portion 285 may be configured to have a pair of crescent-shaped stepped portions 2851. The stepped portions 2851 surround the through hole in the center of the wing portion 285 and are arranged on both sides of the through hole along the tangential direction. There is a small gap between the stepped portion 2851 and the through hole to facilitate assembly. The height of the stepped portion 2851 in the axial direction is equal to or greater than the height of the alignment wall 252 of the boss 251. When the cylindrical portion 286 and the wing portion 285 are assembled together to form the sleeve 28, the lower end surface of the cylindrical portion 286 is flush with the lower end surface of the wing portion 285 (stepped portion 2851). Thus, the sleeve 28 is formed to have the first section 284 of a substantially cylindrical shape and the second section 283 of which the dimension in the tangential direction is larger than the dimension in the radial direction.

In order to fit with the alignment wall 252 of the boss 251, the wing portion 285 further has a cutout portion 2852 at its radially outermost side. The cutout portion 2852 extends upward in the axial direction from the lower end surface of the wing portion 285 (stepped portion 2851). The height of the cutout portion 2852 in the axial direction and the length in the radial direction are respectively greater than or equal to the height and length of the alignment wall 252. In addition, the height of the cutout portion 2852 in the axial direction may be the same as the height of the stepped portion 2851, so that the alignment wall 252 is accommodated in the cutout portion 2852 when the sleeve is mounted to the boss. The radial innermost side of the wing portion 285 may also be provided with a cutout portion to avoid interference between the sleeve 28 and other components.

When the assembled sleeve 28 as shown in FIG. 9*a* is mounted on the main bearing seat 25, referring to FIG. 8*a* and FIG. 8*b*, the upper end surface of the cylindrical portion 286 constitutes the second end surface 282 of the sleeve 28, and the lower end surface of the cylindrical portion 286 and the lower end surface of the wing portion 285 (stepped portion 2851) together constitute the first end surface 281 of the sleeve 28. In addition, the alignment wall 252 of the main bearing seat 25 is placed in the cutout portion 2852 at the radially outermost side of the wing portion 285, so that the alignment wall 252 is in contact with the cutout portion 2852 of the wing portion 285 and/or the outer wall of the cylindrical portion 286. Preferably, the alignment wall 252 is only in contact with the outer wall of the cylindrical portion 286 and not with the cutout portion 2852 of the wing portion 285. Therefore, when the sleeve 28 is mounted on the main bearing seat 25, the positioning of the sleeve 28 in the radial direction is achieved by the cylindrical portion 286 and the alignment wall 252. Since the machining accuracy of the cylindrical portion is high, the machining is more convenient, and the requirement for machining accuracy of the wing portion can be reduced by positioning only with the cylindrical portion. In addition, since the sleeve in the second embodiment can be manufactured by directly adding a wing portion to the outer periphery of the existing cylindrical sleeve, that the alignment wall is not in contact with the cutout portion of the wing portion makes unnecessary to consider the exact matching between the wing portion and the alignment wall during the processing of the wing portion, thereby reducing the processing requirements for the wing portion.

In the tangential direction, the wing portion 285 does not extend beyond the contour of the upper surface 2511 of the boss 251, the outer contour of the wing portion 285 is preferably substantially the same as the contour of the upper surface 2511 of the boss 251, thereby increasing the size of the second section as much as possible within a limited space. In the radial direction, preferably, the radially outermost outer wall of the stepped portion 2851 of the wing portion 285 is substantially flush with the outer wall of the cylindrical portion 286; the radially outermost outer wall of the portion of the wing portion 285 that does not include the stepped portion 2851 is substantially flush with the radially outer side wall of the boss 251. The radially innermost outer wall of the wing portion 285 may be approximately flush with or may slightly exceed the radially inner side wall of the boss 251, as long as the sleeve 25 does not interfere with other components in the compressor. In the axial direction, similar to the first embodiment, in the scroll compressor, preferably the wing portion 285 is located between the flange 226 of the non-orbiting scroll end plate and the boss 251 of the main bearing seat 25, that is, the first section 283 where the wing portions 285 of the sleeve 28 are located is not inserted into the mounting hole of the flange 226, and only the second section 284 of the sleeve 28 is inserted into the mounting hole of the flange 226.

Similar to the first embodiment, since the dimension of the second section 283 of the sleeve 28 in the tangential direction is larger than the dimension in the radial direction, the bending stiffness of the sleeve 28 in the tangential direction is thus increased to match the larger loads experienced by the sleeve in the tangential direction, thereby reducing the bending moment and stress at the end of the bolt, enhancing the fatigue strength of the bolt and greatly reducing the risk of bolt fracture failure. The structure of the sleeve may also effectively prevent the sleeve from rotating and reduce the impression of the sleeve on the boss. Furthermore, in the second embodiment, there is no need to replace the sleeve, by inserting the existing cylindrical sleeve into the wing portion 285, the separately formed sleeve in the second embodiment can be obtained, which is more convenient for production, installation and use, lower in cost and wider in application range.

Figure 10:
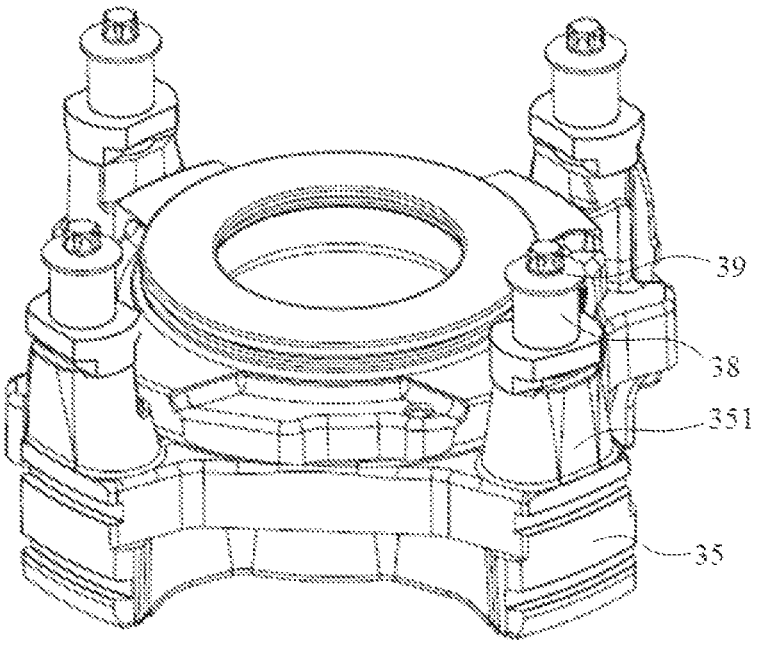
FIG. 10 is a partial perspective schematic view of the scroll compressor according to the third embodiment of the present disclosure, wherein the main bearing seat and the axial flexible mounting mechanisms are shown.
Figure 11A:
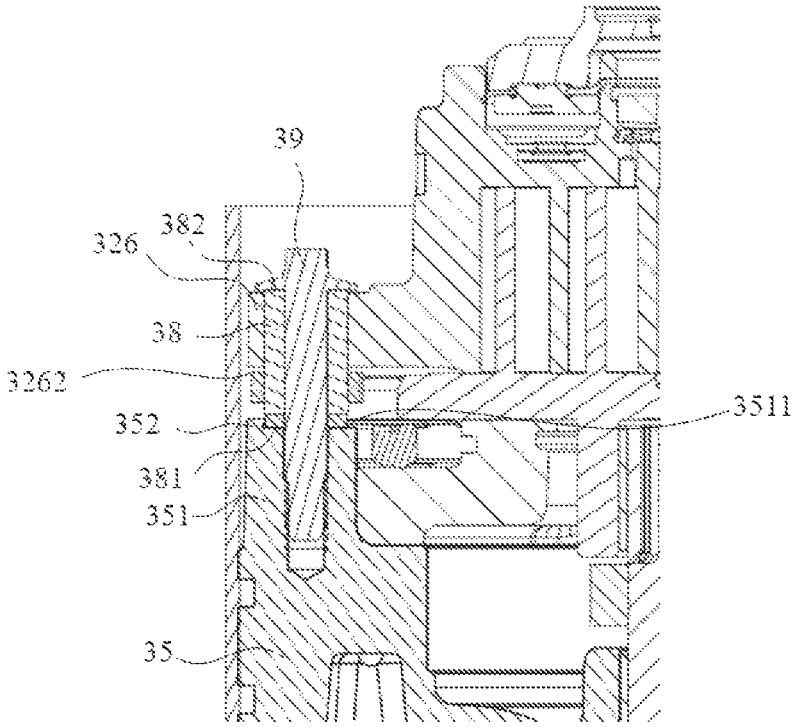
FIG. 11*a* and FIG. 11*b* are respectively a partial radial longitudinal sectional view and a partial tangential longitudinal sectional view of the scroll compressor according to the third embodiment of the present disclosure.
Figure 11B:
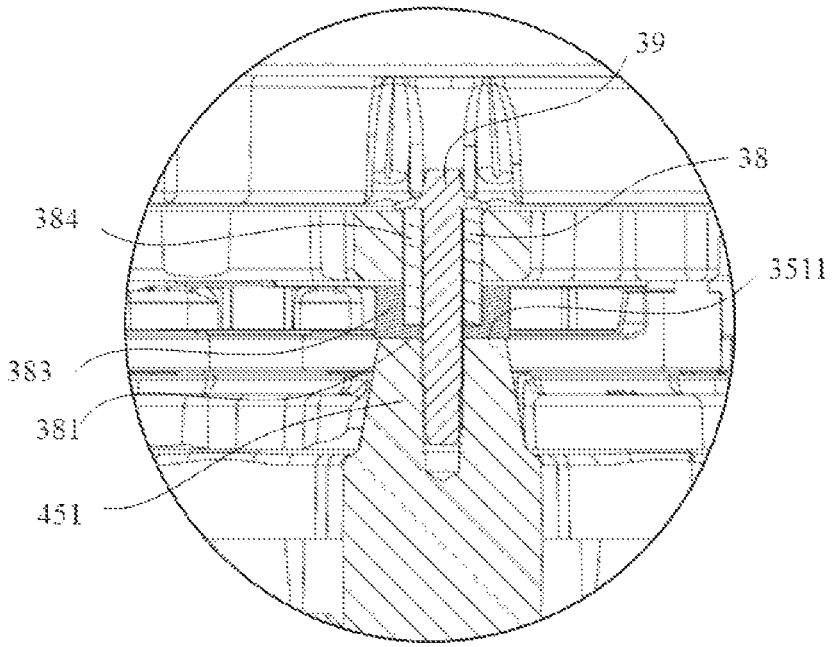

FIG. 10 shows a partial schematic view of the scroll compressor according to the third embodiment of the present disclosure, the axial flexible mounting mechanisms have been mounted on the main bearing seat 35, and the non-orbiting scroll has been removed to allow a clearer view of the axial flexible mounting mechanisms. Referring to FIG. 11*a* and FIG. 11*b*, the sleeve 38 is received in the mounting hole of the flange 326 of the non-orbiting scroll, and is located between the head of the bolt 39 and the upper surface (contact surface) 3511 of the boss 351 of the main bearing seat 35. The second end surface 382 of the sleeve 38 is in contact with the lower surface of the head of the bolt 39, and the first end surface 381 of the sleeve 38 is in contact with the upper surface 3511 of the boss 351.

Figure 12A:
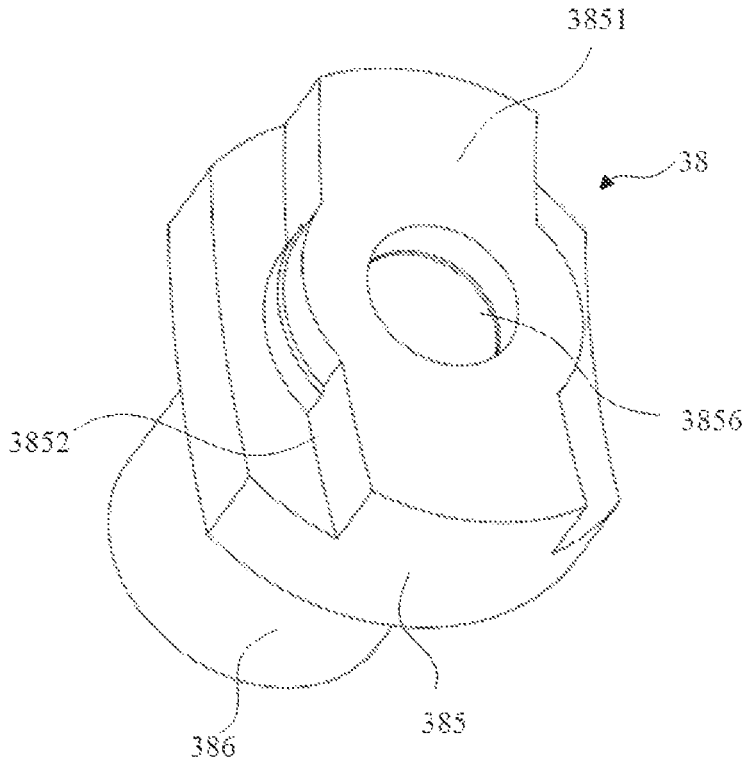
FIG. 12*a* is a schematic perspective view of a sleeve of a scroll compressor according to a third embodiment of the present disclosure.
Figure 12B:
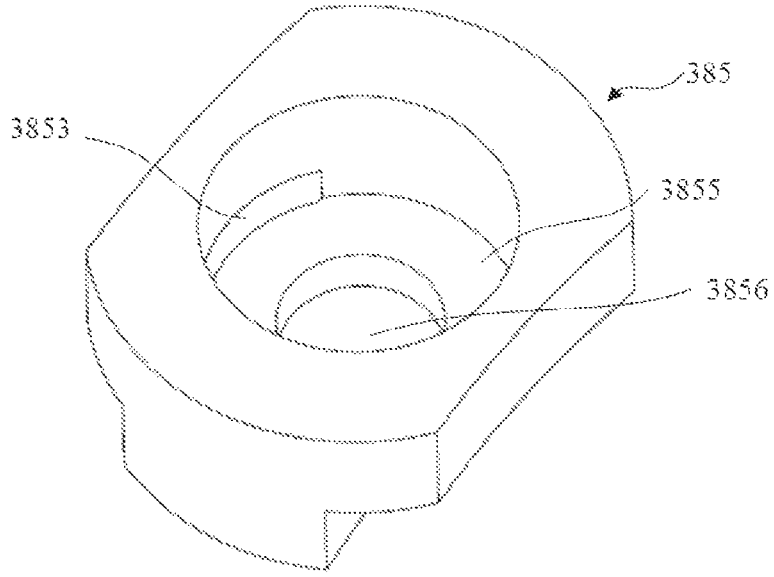
FIG. 12*b* is a schematic perspective view of the wing portion of the sleeve of FIG. 12*a;*

As shown in FIG. 12*a* and FIG. 12*b*, similar to the separately formed sleeve 28 in the second embodiment, the sleeve 38 is configured as an assembly including a cylindrical portion 386 and a wing portion 385 formed separately. FIG. 12*a* shows the sleeve 38 with the cylindrical portion 386 and the wing portion 385 assembled. FIG. 12*b* shows an unassembled wing portion 385, while the cylindrical portion 386 is similar to the substantially cylindrical sleeve structure in the existing scroll compressor, so it is not shown in the figure.

In the third embodiment, the wing portions 385 are also configured to have an outer contour whose dimension in the tangential direction is larger than the dimension in the radial direction. Unlike the second embodiment, the upper surface of the wing portion 385 has a blind hole 3855 having substantially the same diameter as the cylindrical portion 386. The lower surface of the wing portion 385 has a through hole 3856 for the bolt 39 to pass through and matches with the size of the bolt 39. The blind hole 3855 is coaxial and communicated with the through hole 3856. The cylindrical portion 386 is inserted into the blind hole 3855 of the wing portion 385. The lower end of the wing portion 385 is configured to have a stepped portion 3851 provided around the through hole 3856. The stepped portion 3851 preferably has substantially the same size as the cylindrical portion 386 in the radial direction (especially at the radial outer side), and extends from the through hole 3856 to the tangential outermost side of the wing portion 385 in the tangential direction. The height of the stepped portion 3851 in the axial direction may be greater than or equal to the height of the alignment wall 352 of the main bearing seat 35. When the cylindrical portion 386 and the wing portion 385 are assembled together to form the sleeve 38, the lower end surface of the cylindrical portion 386 is not flush with the lower end surface of the wing portion 385 (stepped portion 3851), that is, the cylindrical portion 386 does not run through the wing portion 385. Thus, the sleeve 38 is formed to have the first section 384 of a substantially cylindrical shape and the second section 383 of which the dimension in the tangential direction is larger than the dimension in the radial direction.

In order to expand the application range of the sleeve, the wing portion 385 further has a cutout portion 3852 at its radially outermost side. The cutout portion 3852 extends upward in the axial direction from the lower end surface of the wing portion 385 (or the stepped portion 3851). The height of the cutout portion 3852 in the axial direction may be equal to or greater than the height of the alignment wall 352, and may be equal to the axial height of the stepped portion 3851. The length of the cutout portion 3852 in the radial direction may be equal to or greater than the length of the alignment wall 352. The radial innermost side of the wing portion 385 may also be provided with a cutout portion to avoid interference between the sleeve 38 and other components.

When the assembled sleeve as shown in FIG. 12*a* is mounted on the main bearing seat, referring to FIG. 11*a* and FIG. 11*b*, the upper end surface of the cylindrical portion 386 constitutes the second end surface 382 of the sleeve 38, and the lower end surface of the stepped portion 3851 of the wing portion 385 constitutes the first end surface 381 of the sleeve 38. In addition, the alignment wall 352 of the main bearing seat 35 is accommodated in the cutout portion 3852 at the radially outermost side of the wing portion 385, so that the alignment wall 352 is in contact with the cutout portion 3852 of the wing portion 385 and/or the radially outermost outer wall of the cylindrical portion 386. For example, as shown in FIG. 11*a* and FIG. 12*a*, since the axial height of the through hole 3856 is smaller than the axial height of the stepped portion 3851, and the length of the cutout portion 3852 in the radial direction is greater than the radial length of the alignment wall 352. Therefore, notches 3853 are formed on the radial side walls of the stepped portion 3851, the outer wall of the cylindrical portion 386 is exposed from the notch 3853 of the stepped portion 3851 and is in contact with the alignment wall 352. Similar to the second embodiment, preferably, the alignment wall 352 is only in contact with the outer wall of the cylindrical portion 386 and not with the cutout portion 3852 of the wing portion 385. Therefore, when the sleeve 38 is mounted on the main bearing seat 35, the positioning of the sleeve 38 in the radial direction is achieved by the cylindrical portion 386 and the alignment wall 352.

In the tangential direction, the wing portion 385 does not extend beyond the contour of the upper surface 3511 of the boss 351, the outer contour of the wing portion 385 is preferably substantially the same as the contour of the upper surface 3511 of the boss 351, thereby increasing the size of the second section 383 as much as possible within a limited space. In the radial direction, preferably, the radially outermost outer wall of the stepped portion 3851 of the wing portion 385 is substantially flush with the outer wall of the cylindrical portion 386, and both contact with the alignment wall 352 together; the radially outermost outer wall of the portion of the wing portion 386 that does not include the stepped portion is substantially flush with the radially outer side wall of the boss 352. The radially innermost outer wall 35 of the sleeve 38 may be approximately flush with or may slightly exceed the radially inner side wall of the boss 35, as long as it does not interfere with other components in the compressor. In the axial direction, similar to the above embodiment, in the scroll compressor, preferably the wing portion 385 is located between the flange 326 of the non-orbiting scroll end plate and the boss 351 of the main bearing seat 35, that is, the first section 383 where the wing portions 385 of the sleeve 38 are located is not inserted into the mounting hole of the flange 326, and only the second section 384 of the sleeve 38 is inserted into the mounting hole of the flange 326.

The sleeve 38 in the third embodiment has similar effects to the sleeve 28 in the second embodiment, such as preventing the sleeve from rotating, reducing the impression of the sleeve on the boss, and facilitating production, installation and use. In addition, the sleeve structure in the third embodiment may also obtain greater bending stiffness in the tangential direction, thereby enhancing the fatigue strength of the bolt to a greater extent.

The alignment wall on the boss on the main bearing seat may also be omitted, in which case the position of the sleeve in the radial direction is limited by the inner wall of the housing. FIG. 13 to FIG. 16*b* shows a sleeve that can be mounted on a main bearing seat without an alignment wall.

Figure 13:
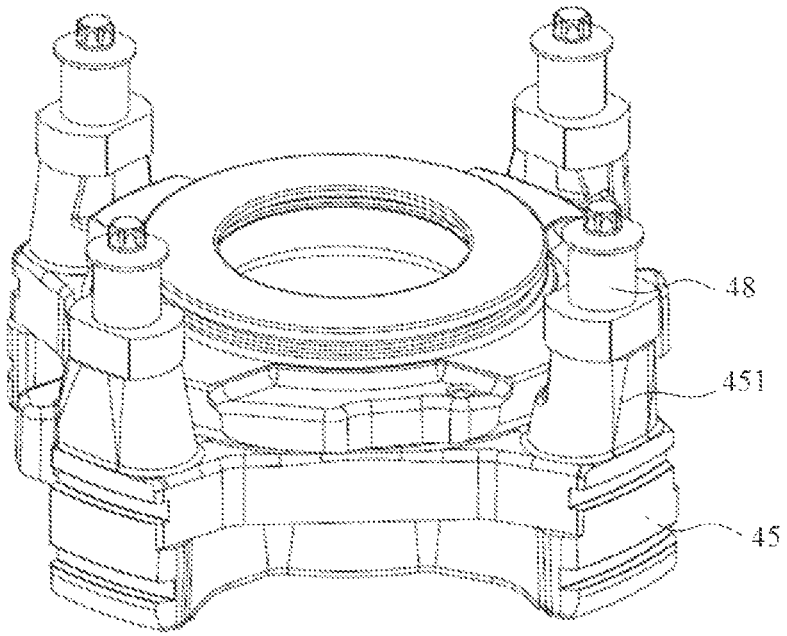
FIG. 13 is a partial perspective schematic view of the scroll compressor according to the fourth embodiment of the present disclosure, wherein the main bearing seat and the axial flexible mounting mechanisms are shown.
Figure 14:
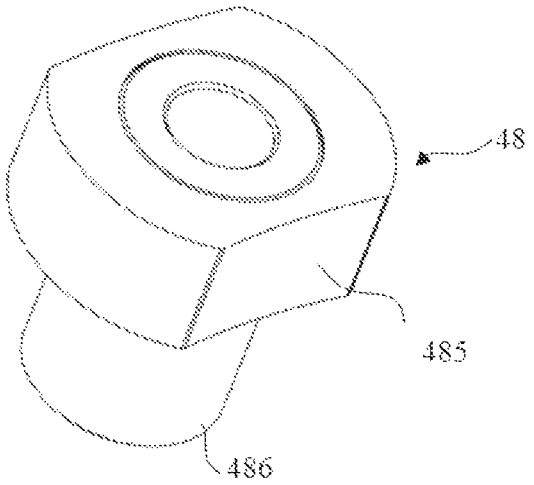
FIG. 14 is a schematic perspective view of a sleeve assembly of a scroll compressor according to a fourth embodiment of the present disclosure.

FIG. 13 and FIG. 14 show a separately formed sleeve 48 in the fourth embodiment, which is similar in structure to the sleeve 28 in the second embodiment. The sleeve 48 has a cylindrical portion 486 and a wing portion 485, and the cylindrical portion 486 is inserted into a through hole in the center of the wing portion 485. Different from the sleeve in the second embodiment, the lower end of the wing portion 485 is not provided with a stepped portion and a cutout portion, but is formed as a flat surface having only a central through hole. The lower end surface of the cylindrical portion 486 is flush with the planar lower end surface of the wing portion 485, thus constituting the first end surface of the sleeve 48. When the sleeve 48 is mounted on the boss 451 of the main bearing seat 45, the first end surface of the sleeve 48 is in contact with the upper surface of the boss 451. Preferably, the outer contour of the first end surface of the wing portion 485 is approximately the same size as the outer contour of the upper surface of the boss 451, which greatly improves the bending moment of the wing portion 485 in the tangential direction, reduces the impression, and is more convenient to manufacture and install.

Figure 15A:
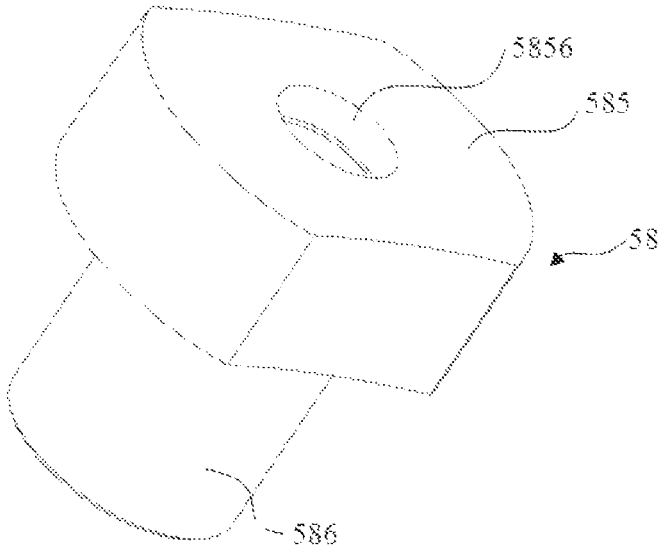
FIG. 15*a* and FIG. 15*b* are a perspective view of a sleeve of a scroll compressor and a perspective view of a wing portion of the sleeve, respectively, according to the fifth embodiment of the present disclosure.
Figure 15B:
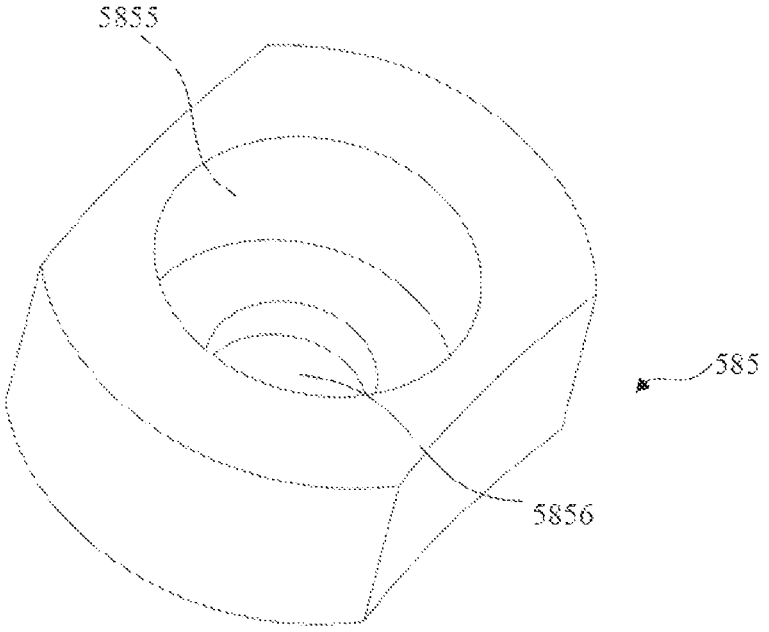

FIG. 15*a* and FIG. 15*b* show a separately formed sleeve 58 in the fifth embodiment, which is similar in structure to the sleeve 38 in the third embodiment. The sleeve has a cylindrical portion 586 and a wing portion 585. The upper surface of the wing portion 585 has a blind hole 5855 matching with the cross-sectional shape of the cylindrical portion 586. The lower surface of the wing portion 585 has a through hole 5856 for the bolt to pass through, and the blind hole 5855 is coaxial with and communicates with the through hole 5856. The cylindrical portion 586 is inserted into the blind hole 5855 of the wing portion 585. Different from the sleeve in the third embodiment, the lower end of the wing portion 585 is not provided with a stepped portion and a cutout portion, but is formed as a flat surface having only a through hole 5856. The lower end surface of the cylindrical portion 586 is not flush with the planar lower end surface of the wing portion 585, and only the lower end surface of the wing portion 585 constitutes the first end surface of the sleeve 58. When the sleeve 58 is mounted on the boss, the first end surface of the sleeve 58 is in contact with the upper surface of the boss. Preferably, the outer contour of the lower end surface of the wing portion 585 (i.e., the first end surface of the sleeve 58) is the same size as the outer contour of the upper surface (contact surface) of the boss, which greatly improves the bending moment of the wing portion in the tangential direction, reduces the impression, and is more convenient to manufacture and install.

In the separately formed sleeve described above, the cylindrical portion and the wing portion are preferably fixedly connected with a slight interference fit. In addition, although in the embodiments of the present disclosure, the inventors have improved the sleeve for the case where the load of the sleeve in the tangential direction is greater than the load in the radial direction, that is, the dimension of the sleeve in the tangential direction is made larger than the dimension in the radial direction. However, those skilled in the art may understand that the improvements of the present disclosure are still applicable to compressors where the load of the sleeve in the radial direction is greater than the load in the tangential direction, it is only necessary to adapt the sleeve to have a larger dimension in the radial direction than in the tangential direction.

Table 1 below lists the simulation analysis results of the stress state of the axial flexible mounting mechanisms in the existing scroll compressor and in the scroll compressor according to the present disclosure, and the comparison is made in two cases, that is, the bolt is in contact with the sleeve and the bolt is not in contact with the sleeve. Referring to FIG. 16*a* and FIG. 16*b*, F represents the tangential force exerted on the sleeve due to the orbiting movement of the orbiting scroll relative to the non-orbiting scroll, and f1 and f2 represent the forces on the upper and lower end surfaces of the sleeve, respectively.

TABLE 1

| | contact between bolt and sleeve | bolt preload (KN) | tangential force F(N) | $f_1$(N) | $f_2$(N) | $f_1$/F (%) | $f_2$/F (%) | bolt bending moment $M_{S\text{-}Thread}$ (Nmm) |
|---|---|---|---|---|---|---|---|---|
| existing design | no | 49 | 4364 | 251.2 | 4112.8 | 5.76% | 94.24% | 7720 |
| | yes | 49 | 4364 | 357.2 | 4006.4 | 8.19% | 91.81% | 9711 (+25.6%) |
| first embodiment of the present disclosure | no | 49 | 4363 | 170.3 | 4193.7 | 3.90% | 96.10% | 4815 (−37.6%) |
| | yes | 49 | 4364 | 251.2 | 411.9 | 5.78% | 9.44% | 5985 (−22.5%) |

As can be seen from Table 1, in the existing scroll compressor, when the sleeve is subjected to a large load (force F) in the tangential direction, the bending moment at the end of the bolt is large, especially when the sleeve comes into contact with the bolt, the bending moment of the bolt may rise sharply by 25.6%, which greatly increases the risk of bolt loosening and fracture. However, in the scroll compressor according to the present disclosure, regardless of whether the bolt is in contact with the sleeve, the bending moment of the bolt is smaller than the bending moment of the bolt in the case where the bolt does not contact the sleeve in the conventional scroll compressor. When the bolt is not in contact with the sleeve, the bending moment of the bolt decreases by 37.6%, even when the bolt is in contact with the sleeve, the bending moment of the bolt is 22.5% lower than the bending moment of the conventional bolt when the bolt is not in contact with the sleeve. Therefore, the scroll compressor according to the present disclosure may significantly improve the fatigue strength of the bolt, and greatly improve the problem of bolt loosening and fracture.

While the present disclosure has been described with reference to the exemplary embodiments, it will be appreciated that the present disclosure is not limited to the specific embodiments described and illustrated in detail herein. The person skilled in the art can make various variants to the exemplary embodiments without departing from the scope defined by the claims. It should further be understood that, provided that there is no contradiction in technical solutions, the features in the various embodiments can be combined with each other, or can be omitted.

The invention claimed is:

1. A scroll compressor, comprising:

a non-orbiting scroll and an orbiting scroll, wherein the orbiting scroll is configured to orbit relative to the non-orbiting scroll to compress a fluid;

a main bearing seat for supporting the orbiting scroll;

an axial flexible mounting mechanism via which the non-orbiting scroll is connected to the main bearing seat, so that the non-orbiting scroll is capable of moving a predetermined distance in an axial direction, wherein the axial flexible mounting mechanism comprises a bolt and a sleeve arranged on the outer periphery of the bolt, wherein the sleeve comprises in the axial direction a first section in contact with the main bearing seat and a second section in contact with the non-orbiting scroll, wherein the first section is configured such that the bending stiffness in a radial direction is different from the bending stiffness in a tangential direction, wherein: for a scroll compressor where the sleeve is subjected to a larger load in the radial direction, the sleeve is configured to have a larger bending stiffness in the radial direction, and for a scroll compressor where the sleeve is subjected to a larger load in the tangential direction, the sleeve is configured to have a larger bending stiffness in the tangential direction.

2. The scroll compressor according to claim 1, wherein the first section is located between the non-orbiting scroll and the main bearing seat, and at least a part of the second section is inserted into a mounting hole of the non-orbiting scroll.

3. A scroll compressor, comprising:

a non-orbiting scroll and an orbiting scroll, wherein the orbiting scroll is configured to orbit relative to the non-orbiting scroll to compress a fluid;

a main bearing seat for supporting the orbiting scroll;

an axial flexible mounting mechanism via which the non-orbiting scroll is connected to the main bearing seat, so that the non-orbiting scroll is capable of moving a predetermined distance in an axial direction, wherein the axial flexible mounting mechanism comprises a bolt and a sleeve arranged on the outer periphery of the bolt, wherein the sleeve comprises in the axial direction a first section in contact with the main bearing seat and a second section in contact with the non-orbiting scroll, wherein the first section is configured such that the bending stiffness in a radial direction is different from the bending stiffness in a tangential direction, wherein the sleeve comprises a cylindrical portion and a wing portion extending outward from the outer periphery of the cylindrical portion, the first section is formed by a section of the sleeve provided with the wing portion, and the second section is formed by a section of the sleeve comprising only the cylindrical portion.

4. The scroll compressor according to claim 3, wherein: the dimension of the wing portion in the tangential direction is different from the dimension of the wing portion in the radial direction, for a scroll compressor where the sleeve is subjected to a larger load in the radial direction, the radial dimension of the wing portion is larger, and for a scroll compressor where the sleeve is subjected to a larger load in the tangential direction, the tangential dimension of the wing portion is larger.

5. The scroll compressor according to claim 4, wherein the main bearing seat comprises a boss connected with the axial flexible mounting mechanism, the wing portion does not extend beyond the outer contour of the boss in the direction in which the sleeve is subjected to a larger load.

6. The scroll compressor according to claim 3, wherein the cylindrical portion and the wing portion are formed integrally or separately.

7. The scroll compressor according to claim 6, wherein when the cylindrical portion and the wing portion are formed separately:

the lower end surface of the cylindrical portion is flush with the lower end surface of the wing portion, and the two end surfaces together constitute the end surface of the sleeve that is in contact with the main bearing seat; or the lower end surface of the cylindrical portion is not flush with the lower end surface of the wing portion, and the lower end surface of the wing portion constitutes the end surface of the sleeve that is in contact with the main bearing seat.

8. The scroll compressor according to claim 6, wherein when the cylindrical portion and the wing portion are formed separately, the cylindrical portion and the wing portion are connected in an interference manner.

9. The scroll compressor according to claim 3, wherein the main bearing seat comprises a boss connected with the axial flexible mounting mechanisms, the boss is provided with an alignment wall extending in the axial direction towards the non-orbiting scroll, the wing portion further comprises a cutout portion extending toward the non-orbiting scroll in the axial direction from the lower end surface of the wing portion that is in contact with the main bearing seat, for accommodating the alignment wall.

10. The scroll compressor according to claim 9, wherein the alignment wall is in contact with the cutout portion and/or the cylindrical portion for limiting the position of the sleeve.

11. The scroll compressor according to claim 3, wherein the lower end of the wing portion is configured to have a pair of crescent-shaped stepped portions, the stepped portions surround a through hole in the center of the wing portion and are arranged on both sides of the through hole along a direction in which the sleeve is subjected to a larger load, the lower end surface of the stepped portions are configured as the lower end surface of the wing portion that is in contact with the main bearing seat.

12. The scroll compressor according to claim 3, wherein the lower end of the wing portion is configured to have one stepped portion, the stepped portion is arranged to surround a through hole in the center of the wing portion, the stepped portion has the same or smaller size than the cylindrical portion in a direction in which the sleeve is subjected to a smaller load, the lower end surface of the stepped portion is configured as the lower end surface of the wing portion that is in contact with the main bearing seat.

13. The scroll compressor according to claim 3, wherein the first section is located between the non-orbiting scroll and the main bearing seat, and at least a part of the second section is inserted into a mounting hole of the non-orbiting scroll.

* * * * *